United States Patent [19]

McDaniel, Jr. et al.

[11] Patent Number: 4,653,654

[45] Date of Patent: Mar. 31, 1987

[54] HYDRAULIC CRANE AERIAL PLATFORM ATTACHMENT

[75] Inventors: Kenneth D. McDaniel, Jr., Midway; Douglas W. Endres; Francis J. Griebel, both of Lexington, all of Ky.

[73] Assignee: FMC Corporation, Chicago, Ill.

[21] Appl. No.: 887,965

[22] Filed: Jul. 21, 1986

Related U.S. Application Data

[63] Continuation of Ser. No. 597,010, Apr. 5, 1984, abandoned.

[51] Int. Cl.[4] ..... B66C 23/26

[52] U.S. Cl. ..... 212/182; 182/141

[58] Field of Search ..... 182/2, 141-149; 212/146, 231, 271, 182; 188/72 B, 196 B; 74/25, 491, 504

[56] References Cited

U.S. PATENT DOCUMENTS

| | | | |
|---|---|---|---|
| 3,154,199 | 10/1964 | Balogh et al. | 182/141 |
| 3,357,522 | 12/1967 | Bradley et al. | 188/72.8 |
| 3,580,104 | 5/1971 | Yashiro et al. | 74/491 |
| 3,642,096 | 2/1972 | Valentine | 182/2 |
| 3,653,461 | 4/1972 | Huxley et al. | 182/2 |
| 3,727,722 | 4/1973 | Hedges et al. | 182/2 |
| 3,830,336 | 8/1974 | Reimbold et al. | 182/2 |
| 4,334,594 | 6/1982 | Jost | 182/2 |
| 4,365,926 | 12/1982 | Brown | 182/2 |
| 4,466,506 | 8/1984 | Dolenti | 182/2 |

*Primary Examiner*—Galen Barefoot
*Assistant Examiner*—Stephen P. Avila
*Attorney, Agent, or Firm*—Ronald C. Kamp; Richard B. Megley

[57] ABSTRACT

An aerial platform attachment for a crane having an extensible boom including a basket pivotally suspended from the boom tip. A loop on the bucket is engaged by a projection secured to the boom when the bucket is pivoted adjacent the boom and the boom is then fully retracted. A brake which is applied by a hand lever movable in either direction from a central release position locks the bucket relative to the boom when in a working position.

4 Claims, 4 Drawing Figures

HYDRAULIC CRANE AERIAL PLATFORM ATTACHMENT

This application is a continuation of application Ser. No. 597,010, filed Apr. 5, 1984 now abandoned.

This invention relates generally to aerial platforms and, more particularly, to such platforms which may be attached to and used with hydraulic cranes.

The present invention provides an aerial platform which is pivotally suspended from a bracket pinned to the cross-shafts projecting beyond a side plate on the boom tip of a hydraulic crane. The pivotal suspension permits the platform to remain level as the crane boom is elevated, while the pinned connection to the cross-shafts allow the attachment to be readily removed and re-installed. The platform includes a basket and is positioned adjacent to the boom tip so that tools or other light materials may be exchanged between the ground and the basket by means of the whip line on the crane. A dash pot, preferably in the form of an automotive shock absorber, attached between the bracket and the platform controls the rate of movement and hence prevents any sudden rotational movement of the platform relative to the boom tip as the boom is elevated into a desired working position. A hand operated brake is provided to prevent rotation of the platform relative to the boom tip while the platform is occupied and in a working position. A means for storing the platform while attached to the boom tip so that the crane remains operable for certain uses and may also be transported in a normal manner is also provided.

Other attributes and advantages of the present invention will become more readily apparent from a perusal of the following description and the accompanying drawings wherein.

Figure 1:
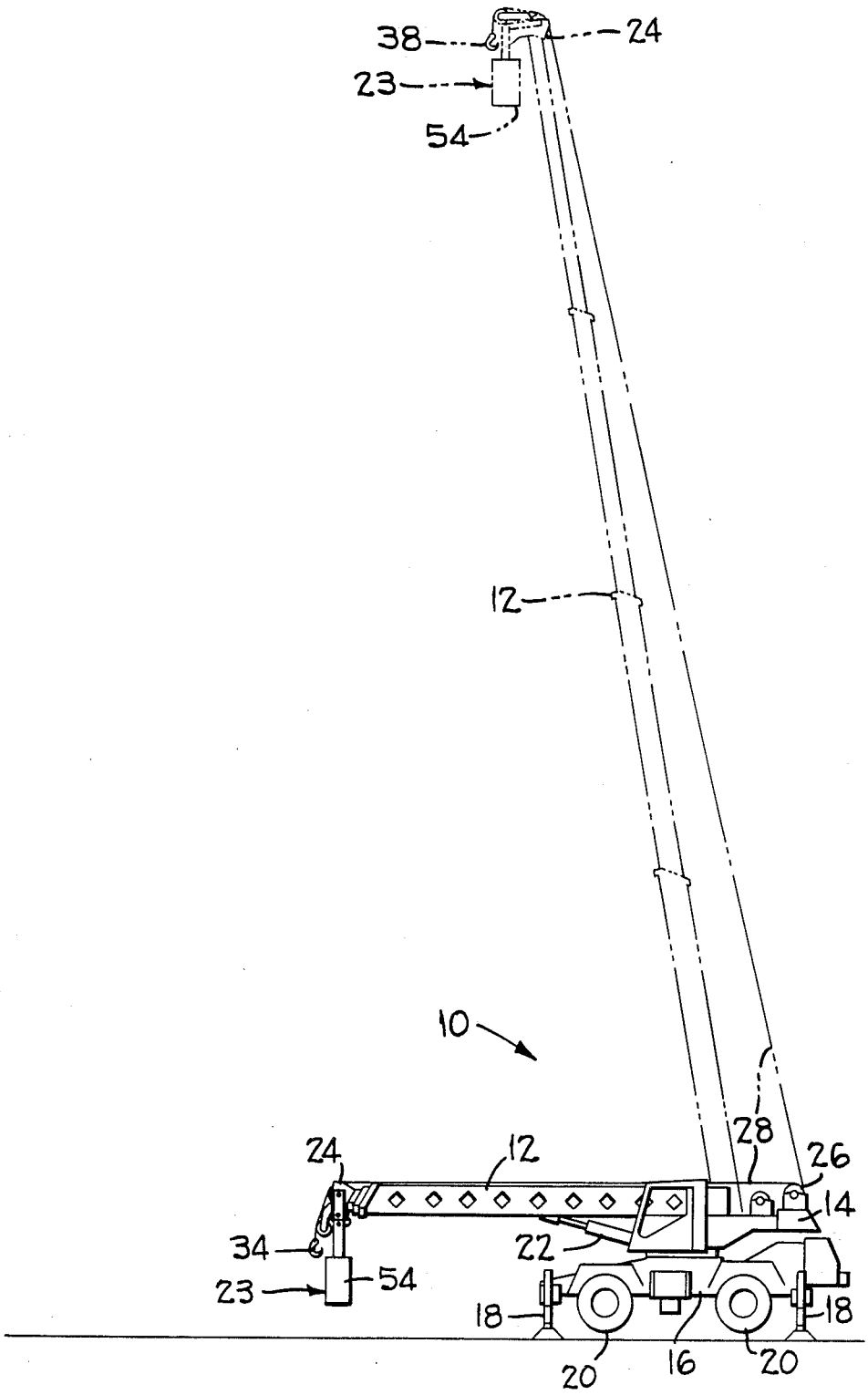
FIG. 1 is a side elevational view of a hydraulic crane with the present invention attached thereto.

Referring to FIG. 1, there is shown a hydraulic crane, indicated generally at 10, having a multi-section, extendable boom 12 pivotally mounted on the crane's upper 14. The upper is rotatable about a vertical axis on the lower 16. As illustrated in FIG. 1, the entire crane 10 is supported for stability on outrigger jacks 18, which may be retracted to permit the wheels 20 on the lower 16 to engage the ground for transport in a conventional manner. Hydraulic cylinder means 22 is connected between the boom 12 and the upper 14. With both the boom and the cylinder means 22 fully retracted, the boom 12 is oriented as indicated by solid lines and when both the boom and the cylinder means are fully extended, the boom 12 is configured as indicated by dotted lines in FIG. 1.

Figures 2, 4:
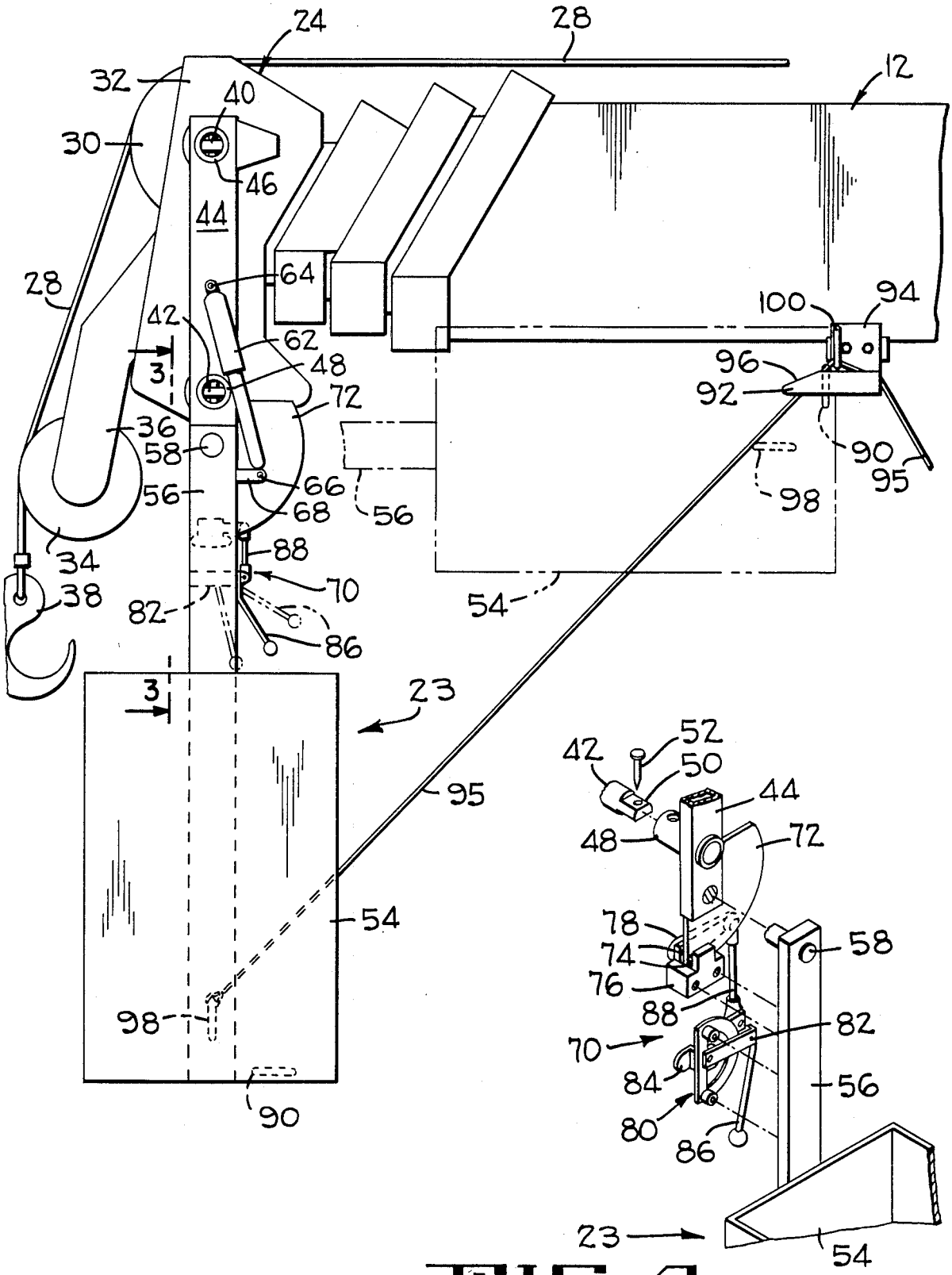
FIG. 2 is a detailed view of the attachment shown in FIG. 1.
FIG. 4 is an expanded view of a preferred embodiment for the brake mechanism utilized in the present invention.

An aerial platform 23 is pivotally suspended from a boom tip 24 secured on the free end of the outer section of the boom 12. An auxiliary hoist 26 mounted on the upper 14 has a wire rope 28, commonly referred to as a whipline, wound thereon and trained over a sheave 30, as shown in FIG. 2, rotatably carried on a cross-shaft between the side plates, one of which is shown at 32, of the boom tip 24 and an auxiliary sheave 34 on a shaft cantilevered from the tip 24 by means of arm 36. A hook 38 is attached to the free end of the wire rope 28. Since both the platform 23 and the auxiliary sheave 34 are suspended from the boom tip 24, the hook 38 will, as it approaches the boom tip as a result of the auxiliary hoist reeling in the wire rope 28, be in close proximity to the platform 23 to enable a worker on the platform to remove or attach material from or to the hook.

Figure 3:
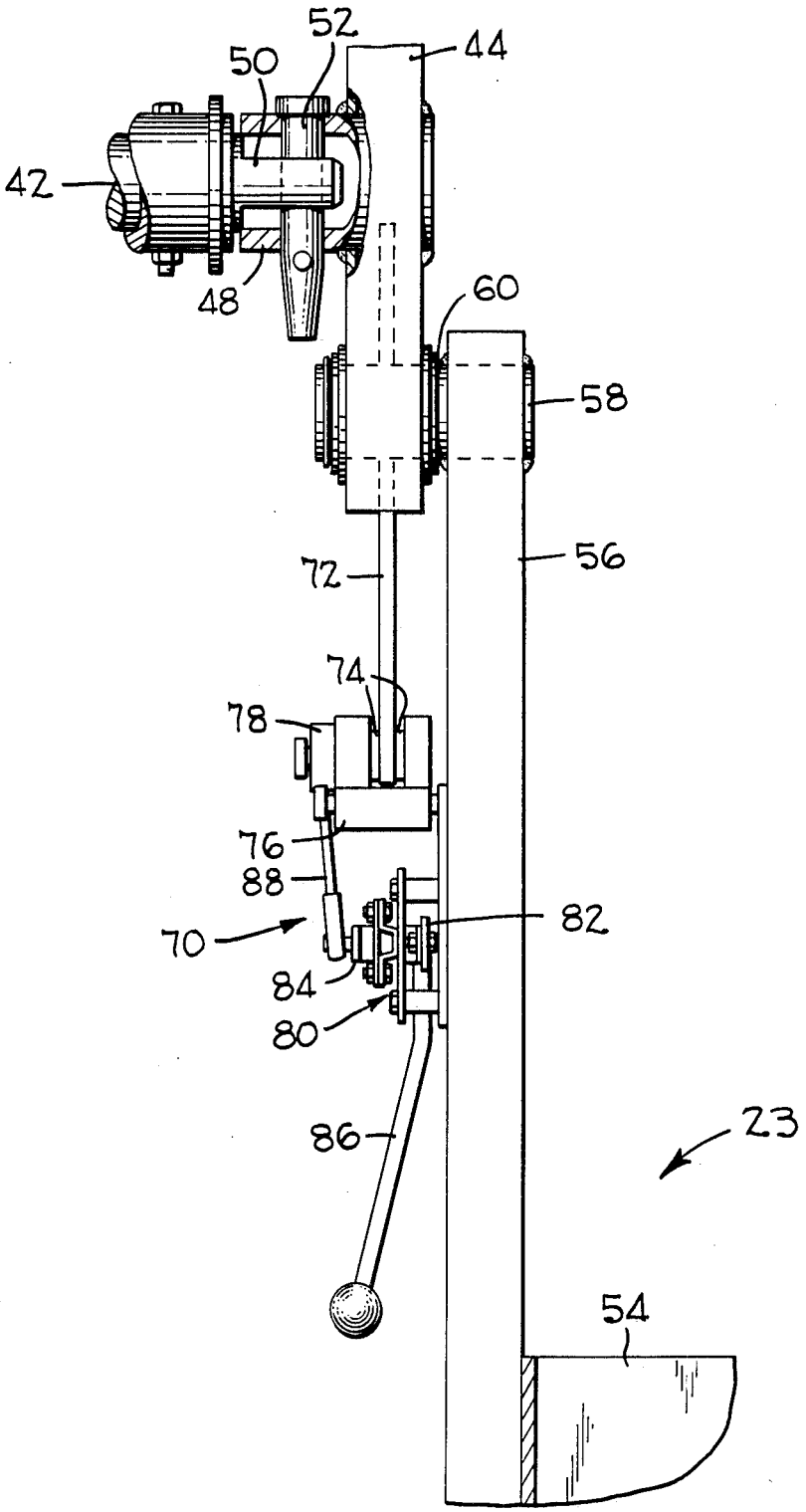
FIG. 3 is a view taken on line 3—3 of FIG. 2 with portions broken away and eliminated.

Referring now to FIGS. 2 and 3, a pair of cross-shafts 40 and 42 project beyond the side plates 32. A bracket 44 has a pair of tubes 46 and 48 secured thereon, which tubes engage the ends of the cross-shafts 40 and 42 respectively. The tubes are cross-bored in alignment with bores provided in end fittings on the cross-shafts, one of which is shown at 50. A pair of pins, one of which is shown at 52 inserted through the tube 48 and the fitting 50, releasably secure the bracket 44 to the boom tip 24. The aerial platform 23 includes a basket 54, preferably constructed of an electrically non-conducting material, such as fiberglass, secured to a suspension link 56. The link 56 is pivotally connected to the bracket 44 by means of a pivot pin 58 attached to the link 56 and rotatably retained within a bushing 60 provided in the bracket 44.

A dash pot, which may be an automotive shock absorber 62, is pivotally attached at 64 to the bracket 44 and at 66 to an arm 68 secured to the link 56. Rotation of the link 56 clockwise, as viewed in FIG. 2, will cause extension of the shock absorber 62, and rotation in the opposite direction will cause retraction. The shock absorber 62 will control the rate of such rotation, and hence will preclude any sudden rotational movement to the basket 54 while the boom is being elevated or lowered. Thus, the basket 54 will remain virtually vertical when moved to and from a working position. Movement of the occupant and the shifting of his or her center of gravity resulting therefrom will not cause an unsettling and unexpected sudden rotation of the basket.

A brake, indicated generally at 70, is provided to lock the link 56 relative to the bracket 44. When so locked by engagement of the brake 70, an occupant of the basket is provided with a stable platform from which work may be performed on elevated structures or lines. The brake 70 includes a rotor sector 72 secured to the bracket 44. Calipers 74 carried by an actuating member 76 secured to the link 56 are capable of engaging the rotor sector 72 to lock the link 56 to the bracket 44. An actuating lever 78 rotatably mounted on the member 76 has a central position, wherein the caliber 74 are out of engagement with sector 72 permitting pivoting of the link 56 relative to the bracket 44, and movement in either directon from its central position causes the caliber 74 to engage to sector 72 thereby locking the link 56 to the bracket 44. Movement of the actuating levers 78 is controlled by a one way control device 80, such as that made by Quadrastat Controls Corp. The control 80 has an input means 82 and output means 84. A hand lever 86 is affixed to the input means 82 and the link 88 is pivotally connected between the output means 84 and the actuating lever 78. The control permits rotation of the output means 84 when a force is applied to the lever 86, but precludes such movement when forces are applied to the output means 84. Consequently, the brake 70 can be released or engaged only through manipulation of the lever 86, and unintentional release or engagement as a result of vibration or other forces applied to the output means 84 will be precluded. The position of the hand lever 86 when the brake 70 is released is shown by solid lines in FIG. 2 and movement of this lever to either of the dotted line positions will cause the brake to engage. Thus, should an occupant need to quickly apply the brake 70 he or she would not have to consider which direction to rotate the hand lever; the brake 70 will be engaged with movement in either direction.

In order to store the basket 56 along side the boom 12, a loop 90 is attached to the side of the basket 54 adjacent to the boom and along the basket's bottom edge. A stabber member 92 is formed on a bracket 94 attached to the boom 12. The stabber member 92 engages the loop 90 when the basket is held parallel to the bottom of the boom and the boom is then fully retracted. An inclined surface 96 on the stabber member 92 cams the basket 54 upward to facilitate full engagement of the loop 90 by the stabber member 92 should the basket 54 not be perfectly parallel to the bottom of the boom 12. In order to move and hold the basket in the proper position for engagement of the stabber member 92 with the loop 90, a rope 95 may be attached to a second loop 98 secured to the basket 54 and passed through a third loop 100 attached to bracket 94. Tension force applied to the rope 95 permits rotation of the basket 54 to its proper position for engagement of the stabber 92 with the loop 90 from a remote position. When the boom is then fully retracted, the stabber 92 will engage the loop 90.

While a preferred embodiment of the present invention has been described and illustrated, it is to be understood that changes and modifications may be made therein without departing from the spirit of the invention is defined by the scope of the appended claims.

What is claimed is:

1. A latchable aerial platform attachment for a crane having two relatively extendible and retractable inner and outer boom sections, comprising, a basket pivotally mounted to said outer boom section to suspend therefrom and swingable between a suspended operating position and an inactive position adjacent said boom, means for swinging said basket to said inactive position whicle said boom sections are relatively extended, first latch means carried by said inner boom section for interengagement with cooperating second latch means on said basket to secure said basket in said inactive position for storage and crane transport, said first and second latch means having elements connectable and detachable solely by axial movement of said basket when in said inactive position prior to final retracting telescoping movement of said inner and outer boom sections, whereby, upon swinging of said basket to said inactive position, further telescoping movement of said boom sections will secure said basket to said crane for storage and transport, while axial separating movement of said boom sections while said basket is in said inactive position will permit said basket to swing to said operating position.

2. The latchable aerial platform attachment of claim 1 wherein said basket swinging means includes a flexible line attached thereto adjacent the bottom thereof, and means guiding said line proximate said inner boom section latch means.

3. The latchable aerial platform attachment of claim 2 wherein said line guiding means includes a loop adjacent said inner boom means through which said line is trained.

4. The latchable aerial platform attachment of claim 1 wherein said first and second latch means comprise a fixed rigid projecting member and an open loop, whereby when axially interengaged, swinging movement of said basket is precluded.

* * * * *